United States Patent [19]

Freilich et al.

[11] 4,367,682

[45] Jan. 11, 1983

[54] RAIL ANCHOR DRIVE MACHINE

[75] Inventors: Max Freilich, Ashtabula; Ramesh C. Gulati, Mentor, both of Ohio

[73] Assignee: True Temper Corporation, Cleveland, Ohio

[21] Appl. No.: 197,014

[22] Filed: Oct. 15, 1980

[51] Int. Cl.[3] ..... E01B 29/32

[52] U.S. Cl. ..... 104/17 A

[58] Field of Search ..... 104/17 A, 17 R, 2

[56] References Cited

U.S. PATENT DOCUMENTS

| | | | |
|---|---|---|---|
| 3,098,453 | 7/1963 | Fee | 104/17 A |
| 3,120,193 | 2/1964 | Pettigrew et al. | 104/17 A |
| 3,438,335 | 4/1969 | McIlrath | 104/17 A |

*Primary Examiner*—Richard A. Bertsch

*Attorney, Agent, or Firm*—Baldwin, Egan, Walling & Fetzer

[57] ABSTRACT

A rail anchor drive machine for boxing and then driving two coacting rail anchors in sequential operations. The machine is operated by a single operator and includes a wheeled frame adapted to be moved along a railroad track having two rails, and an anchor drive mechanism operatively mounted on the frame for operative positioning on either of the two rails when the wheeled frame is disposed at a preselected position on the track. The boxing operation is effected by a single hydraulic piston-cylinder mechanism and the anchor driving operation is effected by a single hydraulic piston-cylinder mechanism. The anchor drive mechanism is free of sliding members, with all connections therein being pivotal.

29 Claims, 8 Drawing Figures

RAIL ANCHOR DRIVE MACHINE

This invention relates to rail anchor drive machines and more particularly to such a machine operated by a single operator that boxes and then drives two coacting rail anchors in sequential operations on either rail of a railway track without removing the machine from the track.

BACKGROUND OF THE INVENTION

There has long been a need for a rail anchor drive machine that is simple in construction, relatively inexpensive to manufacture, and highly effective in operation. Prior machines contain many deficiencies such as numerous sliding parts that jam, the necessity for a plurality of operators, the removal and turn-around of the machine from the track to work on both rails, numerous and unnecessary piston-cylinder mechanisms to effect all operations, etc.

SUMMARY OF THE INVENTION

Therefore, it is an object of the invention to provide a rail anchor drive machine that does not require removal and turn-a-round from the track to work on both rails.

A further object of the invention is to provide a rail anchor machine of the above type that boxes and then drives two coacting push-type rail anchors in sequential operations.

A further object of the invention is to provide a rail anchor drive machine of the above type having an anchor boxing and drive mechanism wherein all moving parts are pivoted to forestall jamming.

A further object of the invention is to provide a rail anchor drive machine of the above type that may be easily operated by a single operator.

A further object of the invention is to provide a rail anchor drive machine of the above type wherein the boxing operation is effected by a single hydraulic piston-cylinder mechanism, and the anchor drive operation is effected by a single hydraulic piston-cylinder mechanism, thus effecting a reduction of power and cooling agents.

A further object of the invention is to provide a rail anchor drive machine of the above type that is simple in construction, relatively inexpensive to manufacture, simple to operate, and highly effective in operation.

BRIEF DESCRIPTION OF THE INVENTION

Briefly, the foregoing objects are accomplished by the provision of a rail anchor driving machine including a wheeled frame adapted to be moved along a railroad track having two rails, and an anchor drive mechanism mounted on the wheeled frame for horizontal movement at one side of the frame and for predetermined vertical movement enabling the anchor drive mechanism to be operatively positioned on either of the two rails when the wheeled frame is disposed at a preselected position on the track. More specifically, the wheeled frame has a centerpost slidably mounted thereon for linear movement from one end of the frame (at one rail) to the other end of the frame (at the other rail). The centerpost is also rotatable about the vertical axis.

A balance arm is pivoted intermediate its ends to the centerpost for limited vertical movement. Disposed at one end of balance arm is an anchor drive mechanism and at the other end of the balance arm there is positioned a drive mechanism hydraulic drive means.

The hydraulic drive mechanism includes a back frame to which a pair of spaced coacting anchor clamp side plates are vertically pivoted for hinged movement toward and away from each other to initially box the anchors preparatory to the anchor driving operation. The hinged motion or boxing motion of the side plates is effected by a single hydraulic piston-cylinder mechanism secured to the free ends of the side plates to form the anchor boxing means. Each side plate has on its inner surface an anchor drive arm pivoted intermediate its ends thereto, such pair of arms being parallel and spaced from each other to coact in driving the boxed anchors into final operative position on the rail base flange. A single hydraulic piston-cylinder mechanism is pivotally secured at its one end to the upper ends of the drive arms by a linkage assembly, and at its other end it is pivoted to the back frame to thus actuate the drive arms. The hydraulic control valves for controlling both piston-cylinder mechanism are disposed on the balance arm directly above the hydraulic drive mechanism.

With this construction, a single operator can easily swing the hydraulic drive mechanism (by means of the wheeled frame-centerpost-balance arm construction) from one track to the other, and thus apply the anchor drive mechanism to either track without removing the wheeled frame from the track. Also, the invention easily and quickly boxes and then drives the two anchors into final operative position in sequential operations by means of the two piston-cylinder mechanisms. All basic motions of the parts in the anchor drive mechanism are pivoted, this forestalling any jamming of parts which occurs with sliding parts of prior constructions.

Other objects and advantages of the invention will be apparent from the following description taken in conjunction with the drawings wherein:

BRIEF DESCRIPTION OF THE DRAWINGS

FIG. 3 is a perspective view of the machine illustrated in FIG. 1, but showing the anchor drive mechanism disposed above the righthand rail and turned 90° from operative position relative to the rail to show the back left portion thereof;

FIG. 8 is an exploded view of certain parts of the linkage assembly connecting the anchor drive means with the anchor drive piston cylinder mechanism and showing certain of such parts in position prior to assembly.

In the drawings, like numbers and letters are used to identify like and similar parts throughout the several views.

Referring first to FIGS. 1–4, there is shown a rail anchor driving machine of the invention operatively positioned on the two rails 10 and 11 of a railway track and including, as main components, the wheeled frame F, the centerpost P, the balance arm B, the anchor drive means or mechanism M, and the anchor drive mechanism hydraulic drive mechanism or means D. For purposes of brevity, the centerpost P, the balance arm B the anchor drive mechanism M, and the drive means D are at times herein referred to as a single unit and identified as the anchor drive apparatus A.

Figure 1:
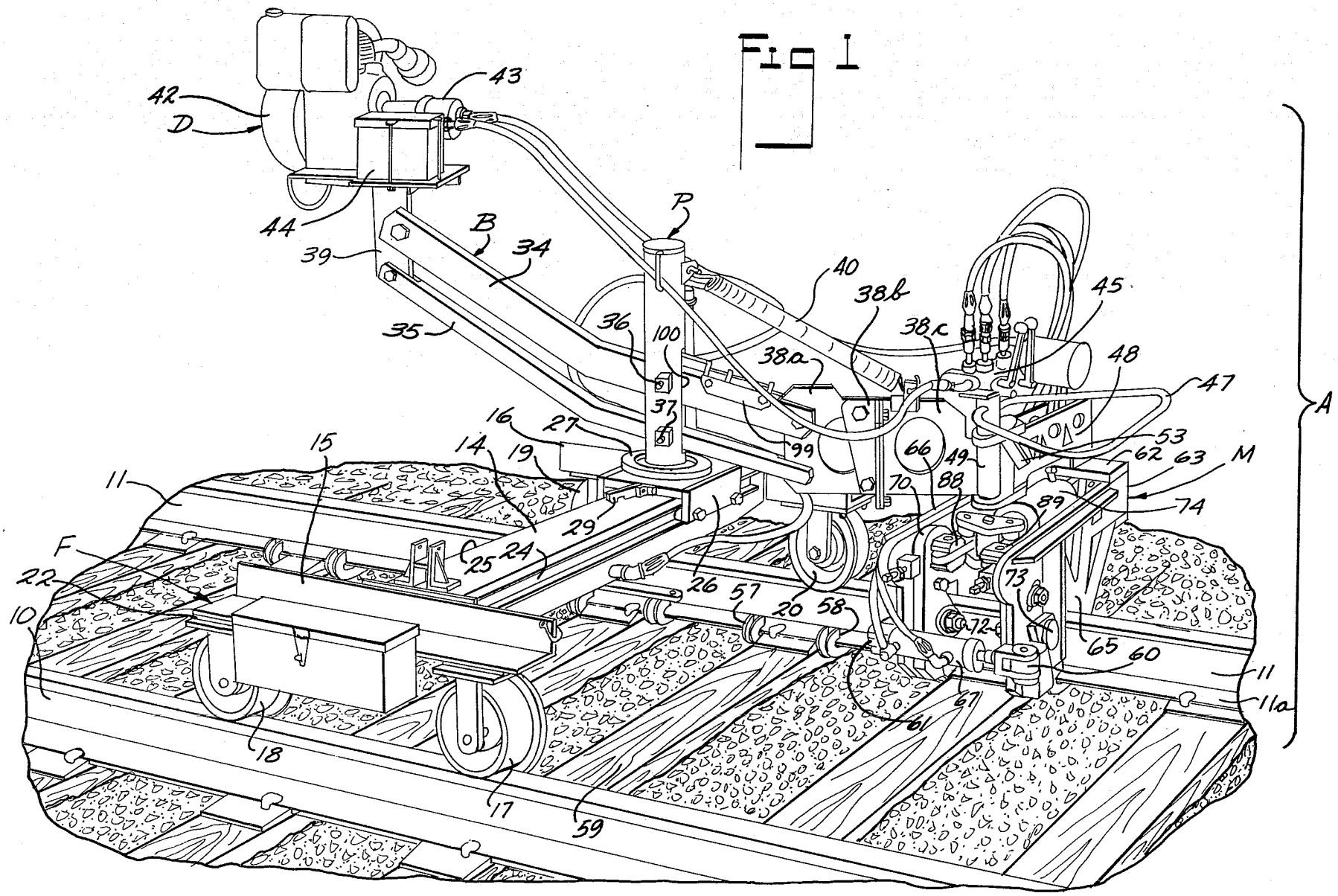
FIG. 1 is a perspective view of a rail anchor driving machine, constructed in accordance with the invention, and showing the rail anchor driving mechanism thereof mounted on the righthand rail in operative position for boxing and driving a pair of rail anchors.

The wheeled frame F is basically an elongated "H" configured frame including an elongated crossbeam 14 secured to a lefthand frame plate or member 15 and a righthand frame plate or member 16, all of which is suitably mounted on the four wheels 17, 18, 19 and 20. Thus, the crossbeam 14 is positioned transversely of (or perpendicular to) the rails 10 and 11. The crossbeam 14 also functions as a hydraulic fluid reservoir tank with hydraulic fluid being fed thereinto by means of the standpipe 21. An insulation sheet 22 is disposed between the wheels and the frame plate 15, as best shown in FIG. 1, to insulate the frame and all the apparatus A thereabove from the wheels.

The centerpost P rotates about its vertical axis and is slidably mounted on the frame crossbeam 14 for linear movement from its one end (at rail 10) to its other end (at rail 11). More specifically, the base of the centerpost P includes an inverted "U"-shaped cam roll plate or assembly 26 slidably mounted on the crossbeam 14 (the sides of the crossbeam 14 forming cam follower tracks 24, 25 for slidably receiving the cam roll plate 26). A circular bearing assembly 27 is mounted on the cam roll plate 26, with the centerpost P being an integral part of the circular bearing assembly 27 to provide the aforedescribed linear and rotative motion of the centerpost. A pair of latch hooks 28 and 29 (FIG. 3) are operatively secured to the base of the centerpost, with the hook 28 adapted to releasably hook onto the righthand frame plate 16 to retain the centerpost at such selective position, and with the hook 29 adapted to releasably hook onto the left frame plate 15 to retain the centerpost thereat. A pair of guide stops 30 and 31 (FIG. 2) are provided in the frame plate 16 to limit the outward movement (to the right in FIG. 2) of the centerpost P. A similar pair of stops (not shown) are provided at the left end of the frame F to limit outward movement of the centerpost thereat.

The balance arm B is operatively secured or pivoted (intermediate its ends) to the centerpost P for selective horizontal movement (i.e. rotation about the centerpost vertical axix) and for predetermined vertical movement about its pivot point. Specifically, the balance arm B includes an upper main support beam 34, and a coating generally parallel lower balance beam 35, each secured or pivoted on (as a unit) to the centerpost P by the pins 36 and 37 respectively. At the right end of the beams 34 and 35 there is pivotally secured thereto a hinge plate 38 for supporting the anchor drive mechanism M in an upright position. At the left end of the beams 34 and 35 there is pivotally secured an engine support bracket 39, which supports the drive means D in an upright position. Thus, the balance arm B is balanced (by the drive D at one end and by the mechanism M at the other end) for vertical movement with respect to the centerpost (and the frame F), such vertical motion being cushioned and controlled by the balance spring 40.

The drive means D includes an engine 42 (preferably a gas engine) which drives a hydraulic pump 43. An engine starting battery 44 is mounted next to the engine 42. The engine 42, the pump 43, and the battery 44 also function together as a counterweight on the balance arm B for the anchor drive mechanism disposed at the other end of the balance arm to effect a balanced system. A hydraulic valve manifold 45 (with the usual valve levers) is disposed at the right end of the balance arm B for controlling operation of the pump P and, in turn, the mechanism M by a single operator. The various hydraulic hose connections between the pump 43, the crossbeam (reservoir) 14, the valve manifold 45, and the anchor drive mechanism M (and the operation of the valves) will not be described in detail as they form no part of the present invention and are readily understood by one skilled in the art.

A handle is provided at the right end (FIG. 1) of the balance arm B to facilitate the aforedescribed horizontal and vertical motion of the balance arm B about the centerpost P, and to move the entire machine along the track.

An anchor drive mechanism suspension bracket 48 is pivotally or hingedly secured to the hinge plate 38 by means of the hinge or pivot 49, the bracket 48, in turn supporting the anchor drive mechanism M, such structure permitting the anchor drive mechanism M to be swung around in a horizontal plane at least 180°. The suspension bracket 48 has two spaced vertical keyways (for example the keyway 52 as shown in FIG. 3) and the handle sleeve 47 has a lift lock lever 53 for engaging such slot(s) to releasably lock the drive mechanism M in a one of two (180° ) preselected horizontal pivotal positions as it is swung around in its aforedescribed 180° + horizontal swing.

The rail anchor drive mechanism M contains both anchor boxing means for first boxing a pair of push-type rail anchors (such anchors initially being placed manually beside the wood tie before the boxing operation), and anchor drive means for then driving such pair of "boxed" anchors into final operative position on the rail base flange. With this structure toeing out of the anchor (wing action) is avoided. For example, in FIG. 1, the paired anchors 57 and 58 are shown "boned" against the wood tie 59 and disposed in final operative position on the base flange 11*a* of the rail 11, such two operations being effected by the mechanism M. Such paired anchors function to prevent horizontal longitudinal creep of the rail on the ties.

The anchor drive mechanism M includes a back frame 62 secured on its top surface to the suspension bracket 48. Vertically pivoted to the back frame 62 at the pivots 63, 64, are a pair of coacting anchor clamp housing side plates 65 and 66, thusly hinged or pivoted to the back frame 62 for hinged movement toward and away from each other in a horizontal plane. A single, unitary hydraulic piston-cylinder mechanism 67 is pivotally secured (at the pivots 60, 61) to the free ends of the side plates 65, 66, to selectively move the side plates about their back frame pivots 63, 64, and thus toward and away from each other (in about a 5° arc) to "box" two coacting anchors against a wood cross-tie and hold them in "boxed" position preparatory to the drive operation.

On the inner side or surface of the left side plate 66 is pivotally disposed an anchor drive arm 70, and pivotally disposed on the inner side of the right side plate 65 is a coacting anchor drive arm 71. The drive arm 70 (FIG. 5) is pivoted on the side plate 66 by the pivot 72, and the drive arm 71 (FIG. 4) is pivoted on the side plate 65 by the pivot 73 (FIG. 1). The drive arms 70, 71 are pivoted or actuated about their pivot points by a single piston-cylinder mechanism 74 which is pivoted at its back end to the back frame 62 at the pivot 75, and pivoted at its front end to the drive arms through a linkage assembly later to be described. Thus there is provided a pair of spaced, parallel, coacting drive arms 70, 71 pivoted to the side plates 66, 65, respectively, to drive (at the lower ends of the drive arms) two "boxed" anchors into final operative position on the rail base flange.

The anchor drive hydraulic piston-cylinder mechanism 74 is pivotally and operatively attached to the drive arms 70, 71 with a pivotal linkage assembly best shown in FIG. 8 and including a vertical link rod 80, the piston-cylinder mechanism 74 having a piston rod 81 pivoted to the link rod 80 for horizontal pivoting. A pair of parallel upper and lower drive yokes 82, 83, are pivoted (intermediate their ends) to the ends of the link rod 80 for horizontal pivoting. A pair of drive links 84 and 85 are pivoted at one end to the ends of the drive yokes 82 and 83 by the pivots 86 and 87 for horizontal pivoting. The other ends of the drive links 84, 85 are pivoted to each respective drive arm clevis 88, 89 on the respective drive arms 70, 71 for vertical pivoting. Thus linear motion of the piston-rod 81 toward the drive arms 70, 71 causes each drive arm to pivot about its side pivot point (72, 73), and thus cause the lower ends of the drive arms to drive the two boxed anchors into final operative position on the rail base flange. The total travel of the top of the drive arms is about 4 inches, and the total length of travel of the bottom of the drive arms (the driving stroke) is about 2 inches.

Each drive arm 70, 71 has a replaceable drive block insert such as, for example, the drive block insert 90 (FIG. 5) secured to the bottom of the drive arm 70 to contact and drive the anchor 91.

Figure 5:
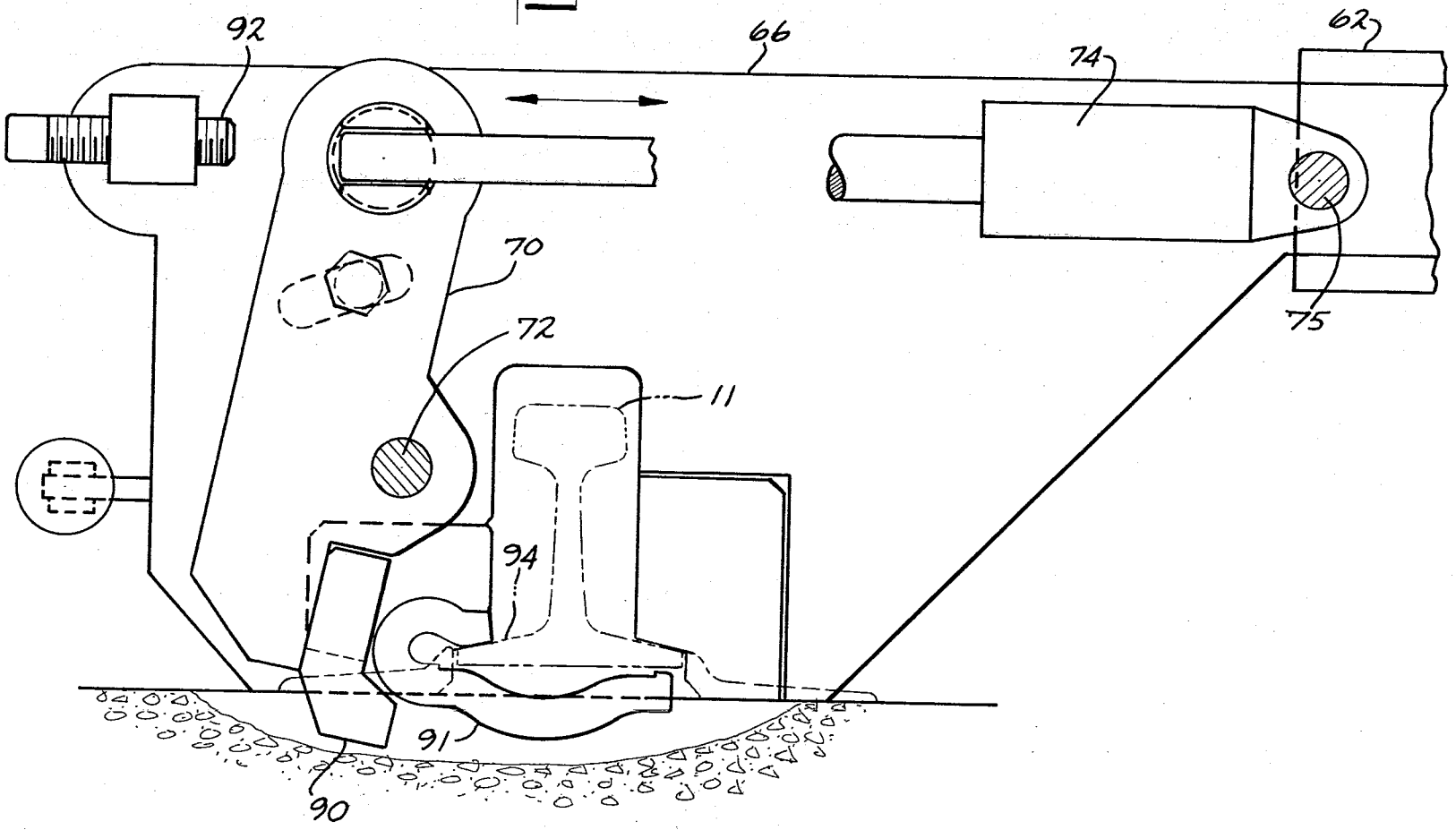
FIG. 5 is an enlarged side elevational sectional (inside) view of the left anchor boxing clamp housing side plate and coacting left anchor drive arm of the anchor drive mechanism illustrated in FIG. 4, and showing the position of the drive arm relative to the anchor just before the anchor is contacted and driven to final operative position on the rail base.
Figure 6:
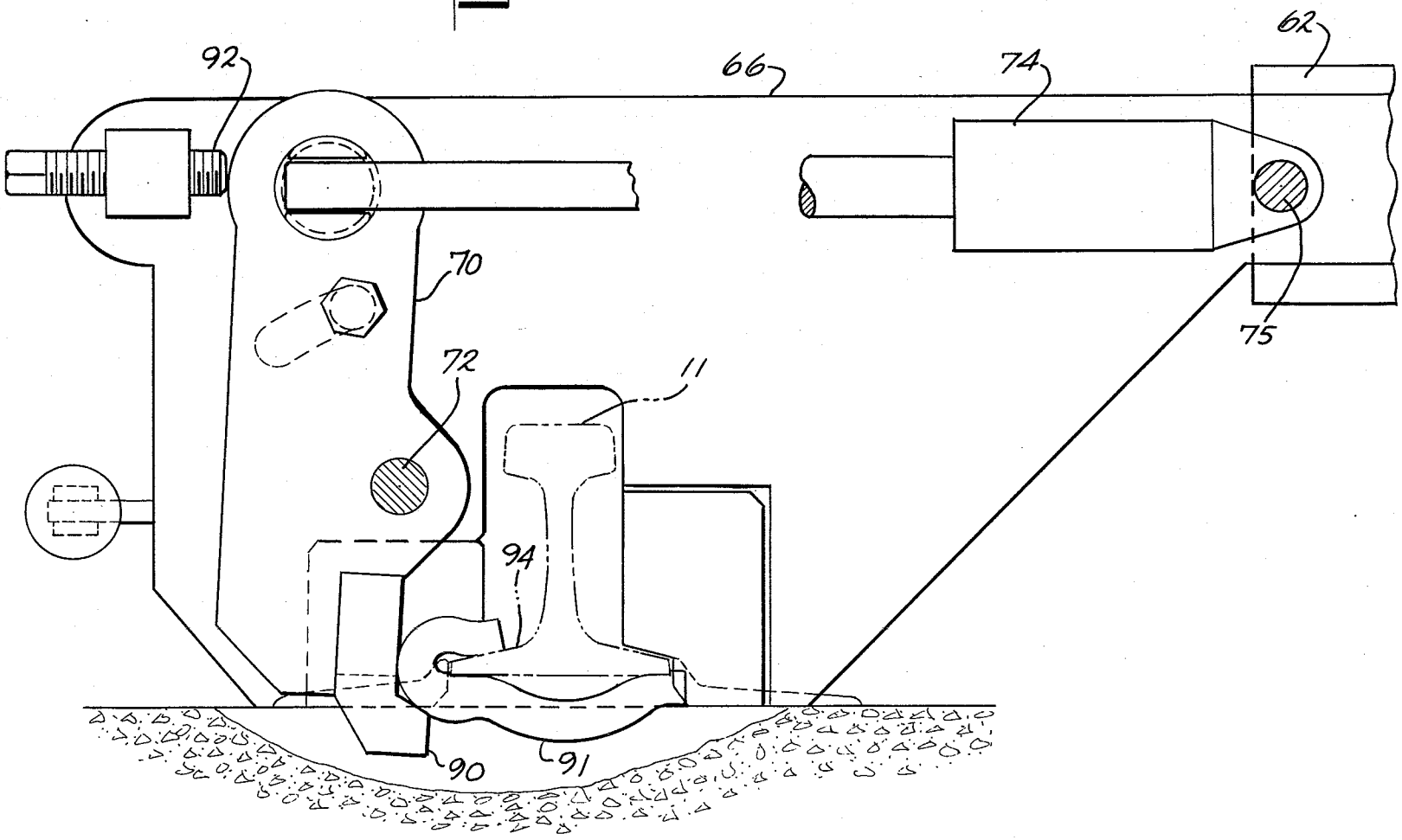
FIG. 6 is a view similar to FIG. 5, but showing the position of the anchor drive arm as it drives the anchor into final operative position on the rail base flange.
Figure 7:
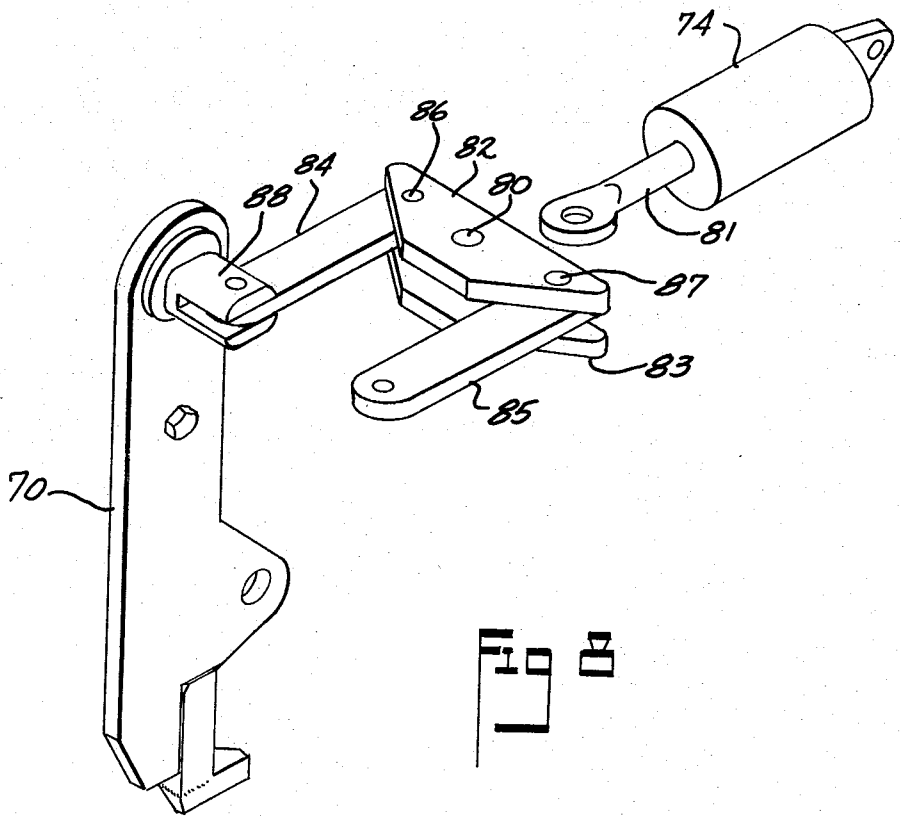

Also provided are a pair of adjustable stops to limit the travel of the upper ends of the drive arms 70, 71, such as for example, the adjustable stop 92 (secured to the side plate 66) shown in FIGS. 5 and 6.

FIGS. 5 and 6 show the action of the drive arms. For example, in FIG. 5 the drive arm 70 is shown in its forward stroke position just before it touches and drives the anchor 91. In FIG. 6, the arm 70 is in its final drive position wherein the anchor is driven onto the rail base flange 94 in final position, and the top of the arm 70 contacts the stop 92.

Figure 7:
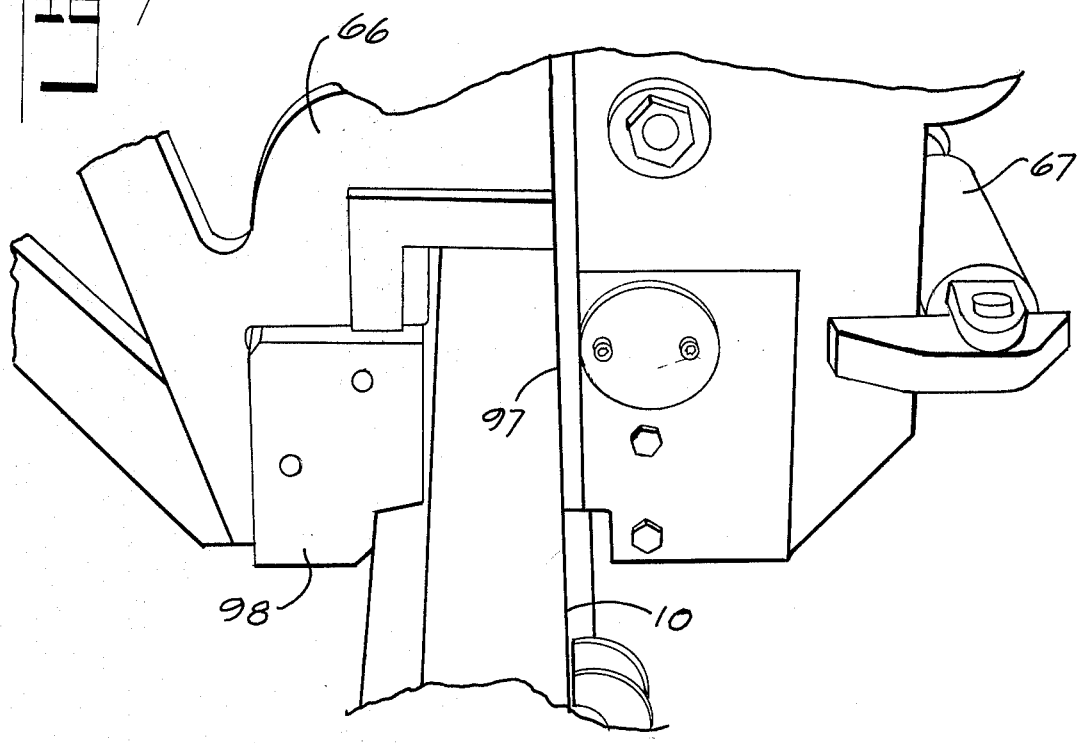
FIG. 7 is an enlarged perspective (outside) view of the bottom portion of the left anchor boxing clamp housing side plate shown in FIG. 4.
Figure 7:
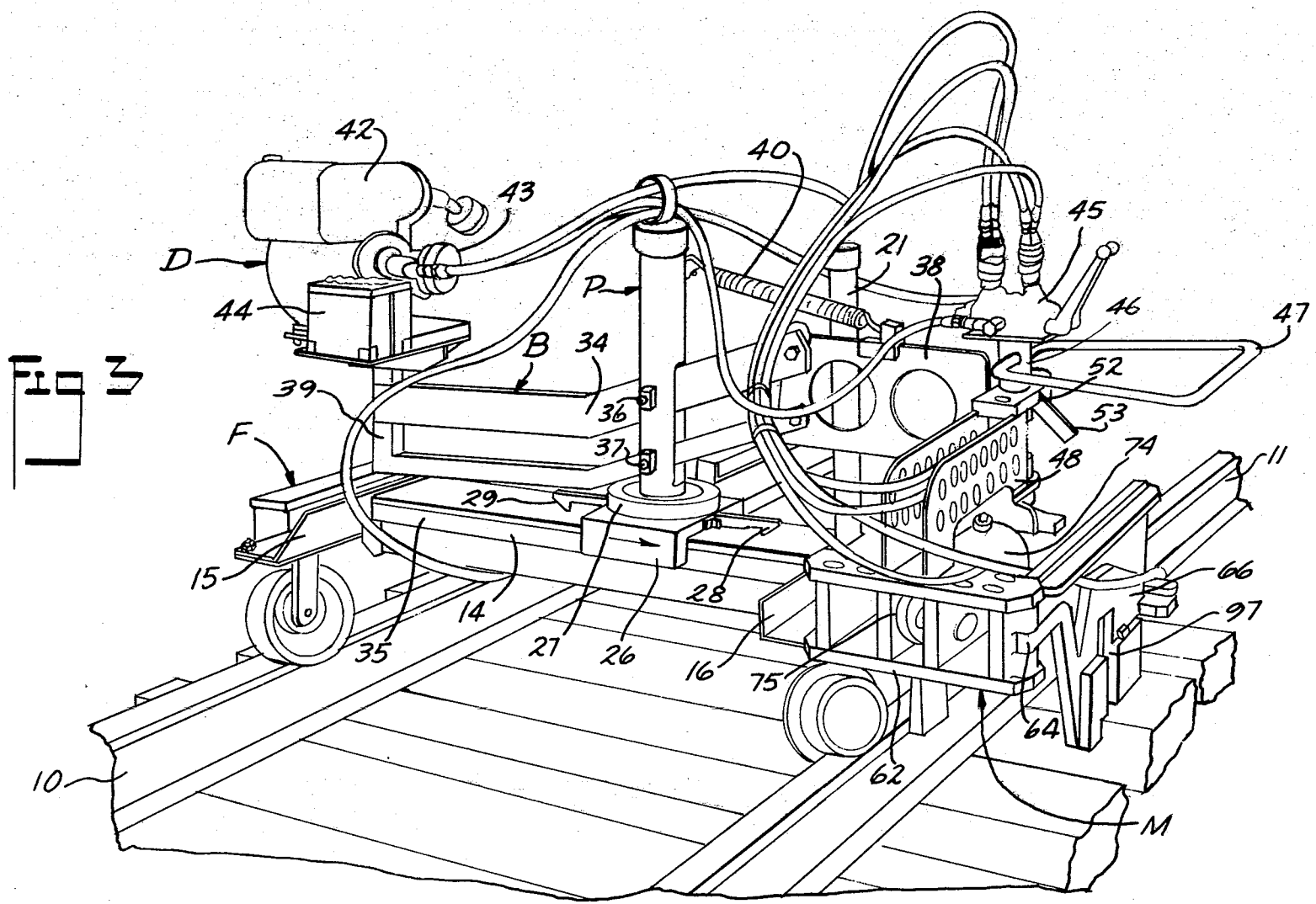
Figure 4:
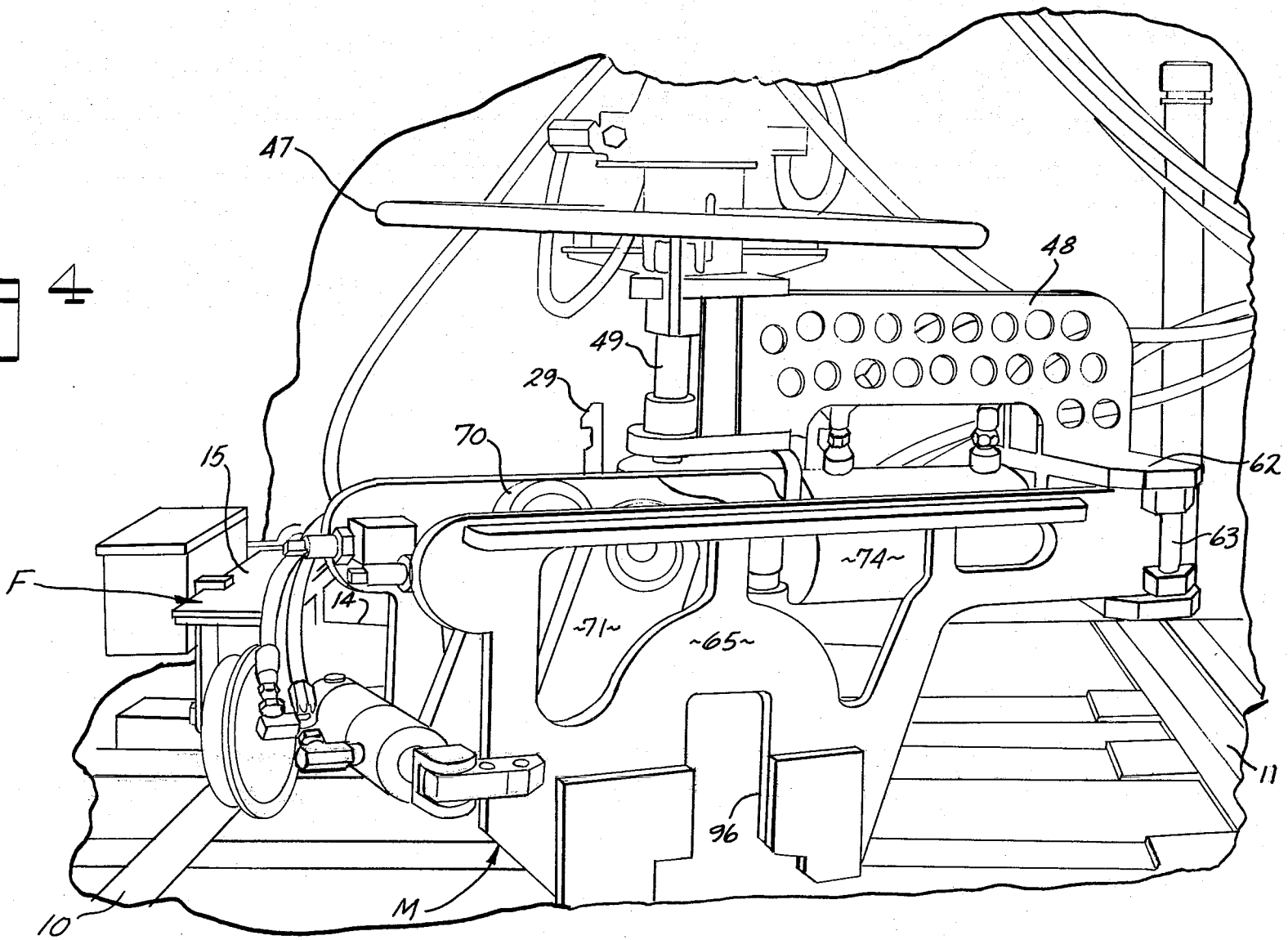
FIG. 4 is an enlarged portional perspective view of the anchor drive mechanism illustrated in FIG. 1, but showing the front right portion thereof.

To guide the mechanism M into final operative position on the rail, the side plates 65, 66 each have respective guide slots 96, 97, to assist the operator in lowering and guiding the mechanism M onto the rail in correct position. As best shown in FIG. 7, a replaceable guide plate 98 is detachably disposed on the side plate 66 next to the slot 97 on the field side of the rail to guide placement of the mechanism M into final position on the rail (the guide plate 98 also acting as a final stop as such guide plate rests on the rail base flange). The guide plate also functions as a counterforce to the action of the drive arms 70, 71.

The mechanism M, with its plurality of pivot connections, is thus self-aligning to compensate for any cross-ties that do not lie substantially perpendicular to the rails.

Referring to FIG. 1, it will be noted that the upper support beam 34 has operably attached to it a lift limit latch 99, the front portion of which selectively and releasably engages the upper end of the slot 100 on the centerpost to limit the upward motion of the balance arm B. Such latch 99 is spring-biased to normally engage the slot 100.

Figure 2:
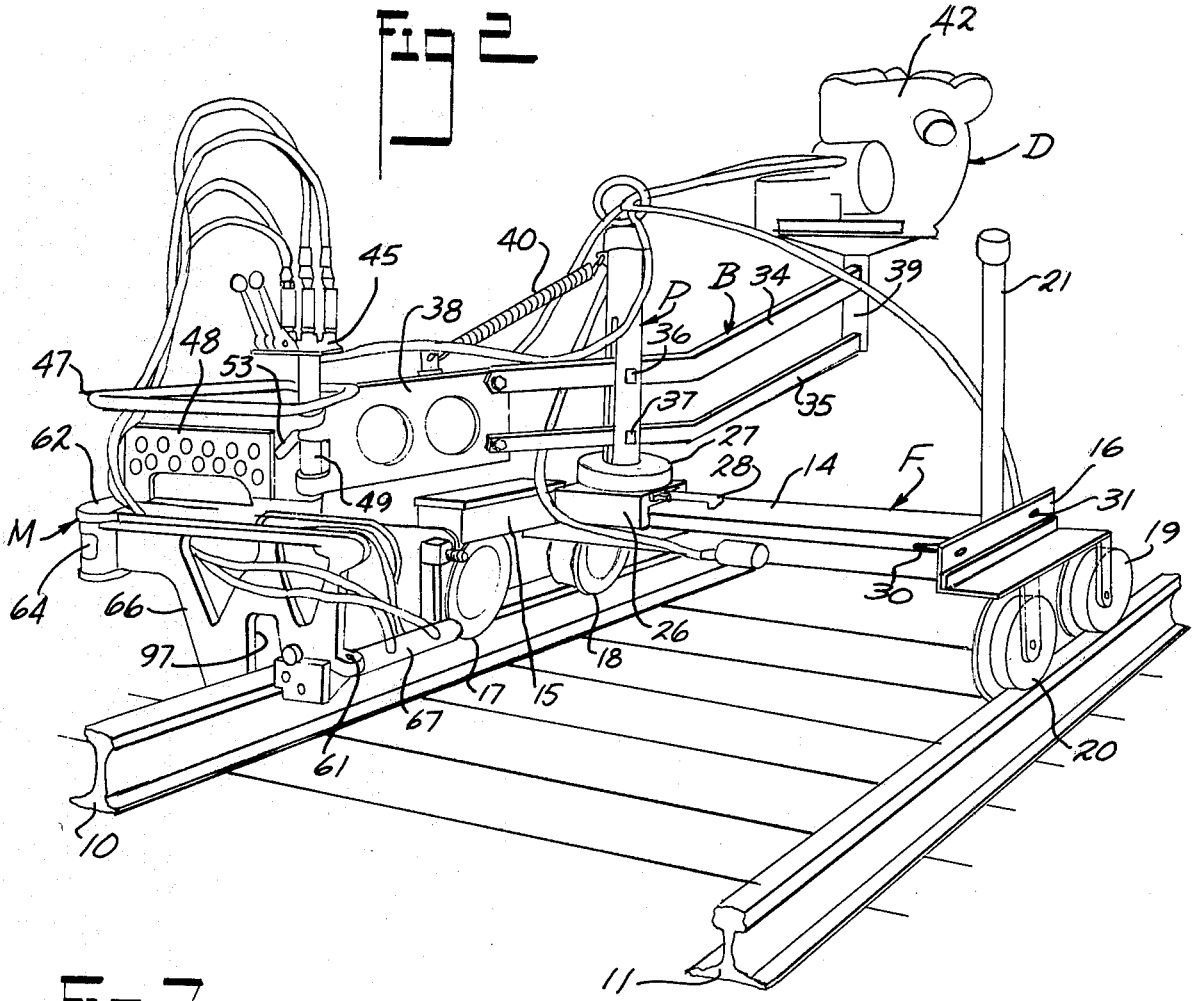
FIG. 2 is a perspective view of the machine illustrated in FIG. 1, but showing the rail anchor driving mechanism ready for placement into final operative position on the lefthand rail.

FIG. 1 also shows a modification of the hinge plate 38. More specifically, the single hinge plate 38, as shown in FIGS. 2 and 3, has been modified into three coacting component plates 38*a*, 38*b*, and 38*c*, with the bolted connections thereof having appropriate slot elongations to facilitate two-way leveling of the anchor drive mechanism M.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A rail anchor driving machine comprising:

a wheeled frame adapted to be moved along a railroad track having two rails, a balance arm operatively secured intermediate its ends to said wheeled frame for selective horizontal movement and predetermined vertical movement relative to the frame, an anchor drive mechanism disposed at or adjacent one end of the balance arm, and anchor drive mechanism drive means disposed on the balance arm and generally adjacent the other end of the balance arm enabling the balance arm to balance the anchor drive mechanism and the anchor drive mechanism drive means, whereby the anchor drive mechanism may be operatively positioned on either of the two rails when the wheeled frame is disposed at a preselected position on the track and without removing the wheeled frame from the track.

2. The structure of claim 1 wherein said anchor drive mechanism includes coacting means for boxing and then driving two coacting rail anchors in sequential operations.

3. A rail anchor driving machine comprising:

a wheeled frame adapted to be moved along a railroad track having two rails, a vertical centerpost operatively disposed on said frame, a balance arm operatively secured intermediate its ends to said centerpost for selective horizontal movement and predetermined vertical movement relative to the frame, an anchor drive mechanism disposed at or adjacent one end of the balance arm, and anchor drive mechanism drive means disposed on the balance arm and generally adjacent the other end of the balance arm whereby the anchor drive mechanism may be operatively positioned on either of the two rails when the wheeled frame is disposed at a preselected position on the track and without removing the wheeled frame from the track.

4. A rail anchor driving machine comprising:

a wheeled frame adapted to be moved along a railroad track having two rails, a vertical centerpost rotatable about its vertical axis and slidably mounted on said wheeled frame for linear movement from one end of the frame adjacent one track to the other end of the frame adjacent the other track, a balance arm operatively pivoted intermediate its ends to said centerpost for predetermined vertical movement about its pivot relative to the frame, an anchor drive mechanism disposed at or adjacent one end of the balance arm, and anchor drive mechanism drive means disposed on the balance arm and generally adjacent the other end of the balance arm whereby the anchor drive mechanism may be operatively positioned on either of the two rails when the wheeled frame is disposed at a preselected position on the track and without removing the frame from the track.

5. The structure of claim 4 and further including a balance spring secured to the centerpost and to the balance arm to cushion the vertical movement of the balance arm.

6. The structure of claim 4 wherein said anchor drive mechanism is pivoted to said balance arms for pivotal movement in a horizontal plane.

7. The structure of claim 6 and further including a suspension bracket for pivotally securing the anchor drive mechanism to the balance arm, said suspension bracket being pivotally secured at one end to said one end of the balance arm and being secured at its other end to said anchor drive mechanism, said one end of the suspension bracket having a plurality of spaced vertical keyways, and a handle sleeve secured to the handle and having a lift lock lever for selectively engaging any of said vertical keys to releasably lock the anchor drive mechanism in a preselected horizontal pivotal position to the handle.

8. The structure of claim 4 wherein said wheeled frame includes four wheels and an insulation sheet disposed between the wheels and the frame to insulate the frame from the track.

9. The structure of claim 4 wherein said drive means is an engine driven hydraulic pump.

10. The structure of claim 9 wherein said frame includes a hydraulic fluid tank which functions as the hydraulic fluid reservoir for said hydraulic pump.

11. The structure of claim 9 and further including a hydraulic valve manifold disposed on the one end of the balance arm and hydraulically connected to said pump and to said anchor drive mechanism to control the same, thereby enabling a single operator to operate said machine.

12. The structure of claim 9 wherein said balance arm includes an upper main support beam, a coacting generally parallel lower balance beam, a hinge plate pivoted to said support beam and said balance beam at said one end for supporting said anchor drive mechanism in an upright position, and an engine support bracket pivoted to said support beam and said balance beam at said other end to support said anchor drive means in a generally upright position.

13. The structure of claim 4 wherein said centerpost is mounted on a base comprising, an inverted "U" shaped cam roll plate assembly slidably mounted on said frame for linear movement from one end of the frame to the other end thereof, and a circular bearing assembly mounted on said cam roll plate assembly for rotation about the centerpost vertical axis, said centerpost being mounted on said bearing assembly.

14. The structure of claim 13 and further including spaced latch hooks on said cam roll assembly for hooking onto the respective ends of the frame to releasably secure the centerpost to either end of said wheeled frame.

15. The structure of claim 14 and further including guide stops disposed at each end of the frame for limiting movement of the centerpost at each end of the frame.

16. A rail anchor drive mechanism for boxing two coacting rail anchors against a railway track cross-tie and for driving the two boxed anchors into final operative position on a railway rail base flange comprising:

a back frame, a pair of coacting anchor clamp housing side plates vertically pivoted to said back frame for hinged movement toward and away from each other in a horizontal plane, single unitary boxing drive means pivotally secured to said side plates for selectively moving the plates about their back frame pivots and toward each other to box the two coacting anchors against the cross-tie, a pair of coacting anchor drive arms pivoted to said side plates, and a single unitary anchor arm drive means operatively pivoted to said back frame and to said drive arms to drive the two boxed anchors into final operative position on the rail base flange.

17. The structure of claim 16 wherein said drive means is a single unitary hydraulic piston-cylinder mechanism, and said anchor arm drive means is a single unitary hydraulic piston-cylinder mechanism.

18. A rail anchor drive mechanism for boxing two coacting rail anchors against a railway track cross-tie and for driving the two boxed anchors into final operative position on a railway rail base flange comprising:

a back frame, a pair of coacting anchor clamp housing side plates vertically pivoted to said back frame for hinged movement toward and away from each other in a horizontal plane, a single hydraulic boxing piston-cylinder mechanism pivotally secured to said side plates for selectively moving the plates about their back frame pivots and toward each other to box the two coacting anchors against the cross-tie, a pair of coacting anchor drive arms pivoted intermediate their ends to said side plates, and a single anchor drive hydraulic piston-cylinder mechanism operatively pivoted to said back frame and to the upper end of said drive arms to drive the pivot arms about their side plate pivot points and cause the lower end of the drive arms to drive the two boxed anchors into final operative position on the rail base flange.

19. The structure of claim 18 wherein each side plate has an open-ended slot on its lower edge, and a guide plate disposed adjacent said slot on the field side of the rail to guide placement of the rail anchor drive mechanism into final operative position on the rail and to function as a counter-force to the action of the drive arms.

20. The structure of claim 18 wherein said anchor drive hydraulic piston-cylinder mechanism is operatively attached to said drive arms with a pivotal linkage assembly comprising, a vertical link rod, said hydraulic piston-cylinder mechanism having a piston-rod pivoted to said link rod for horizontal pivoting, a pair of parallel upper and lower drive yokes pivoted intermediate their ends to the ends of the link rod for horizontal pivoting, a pair of drive links pivoted at one end to the ends of the drive yokes for horizontal pivoting, and each said drive arm having a drive arm clevis for pivotally receiving the free end of its respective drive link for vertical pivoting, each said drive arm being pivoted intermediate its ends to its respective side plate, whereby linear motion of the piston rod toward the drive arms causes each drive arm to pivot about its side plate pivot point and thus cause the lower end of the drive arms to drive the two boxed anchors into final operative position on the rail base flange.

21. The structure of claim 20 wherein each drive arm has a replaceable drive block insert at its lower end to contact and drive the anchor.

22. The structure of claim 18 and further including a pair of adjustable stops secured to the respective side plates opposite the upper ends of the drive arms to limit the travel of the upper ends of the drive arms.

23. A rail anchor driving machine comprising:

a wheeled frame adapted to be moved along a railroad track having two rails, a vertical centerpost rotatably about its vertical axis and slidably mounted on said wheeled frame for linear movement from one end of the frame adjacent one track to the other end of the frame adjacent the other rail, a balance arm operatively pivoted intermediate its ends to said centerpost for predetermined vertical movement about its pivot relative to the frame, an anchor drive mechanism disposed at or adjacent one end of the balance arm, and anchor drive mechanism drive means disposed adjacent the other end of the balance arm whereby the anchor drive mechanism may be operatively positioned on either of the two rails when the wheeled frame is disposed at a preselected position on the track and without removing the frame from the track, said anchor drive mechanism comprising;

a back frame, a pair of coacting anchor clamp housing side plates vertically pivoted to said back frame for hinged movement toward and away from each other in a horizontal plane, single unitary boxing drive means pivotally secured to said side plates for selectively moving the plates about their back frame pivots and toward each other to box two associated coacting anchors against an associated cross-tie, a pair of coacting anchor drive arms pivoted to said side plates, and a single unitary anchor arm drive means operatively pivoted to said back frame and to said drive arms to drive the two boxed anchors into final operative position on the rail base flange.

24. The structure of claim 23 wherein said drive means is a single unitary hydraulic piston-cylinder mechanism, and said anchor arm drive means is a single unitary hydraulic piston-cylinder mechanism.

25. A rail anchor driving machine comprising:

a wheeled frame adapted to be moved along a railroad track having two rails, a vertical centerpost rotatably about its vertical axis and slidably mounted on said wheeled frame for linear movement from one end of the frame adjacent one rail to the other end of the frame adjacent the other rail, a balance arm operatively pivoted intermediate its ends to said centerpost for predetermined vertical movement about its pivot relative to the frame, an anchor drive mechanism disposed at or adjacent one end of the balance arm, and anchor drive mechanism drive means disposed adjacent the other end of the balance arm whereby the anchor drive mechanism may be operatively positioned on either of the two rails when the wheeled frame is disposed at a preselected position on the track and without removing the frame from the track, said rail anchor drive mechanism comprising;

a back frame, a pair of coacting anchor clamp housing side plates vertically pivoted to said back frame for hinged movement toward and away from each other in a horizontal plane, a single hydraulic boxing piston-cylinder mechanism pivotally secured to said side plates for selectively moving the plates about their back frame pivots and toward each other to box two associated coacting anchors against an associated cross-tie, a pair of coacting anchor drive arms pivoted intermediate their ends to said side plates, and a single anchor drive hydraulic piston-cylinder mechanism operatively pivoted to said back frame and to the upper end of said drive arms to drive the pivot arms about their side plate pivot points and cause the lower end of the drive arms to drive the two boxed anchors into final operative position on an associated rail base flange.

26. The structure of claim 25 wherein each side plate has an open-ended slot on its lower edge, and a guide plate disposed adjacent said slot on the field side of the rail to guide placement of the rail anchor drive mechanism into final operative position on the rail and to function as a counter-force to the action of the drive arms.

27. The structure of claim 25 wherein said anchor drive hydraulic piston-cylinder mechanism is operatively attached to said drive arms with a pivotal linkage assembly comprising, a vertical link rod, said hydraulic piston-cylinder mechanism having a piston-rod pivoted to said link rod for horizontal pivoting, a pair of parallel upper and lower drive yokes pivoted intermediate their ends to the ends of the link rod for horizontal pivoting, a pair of drive links pivoted at one end to the ends of the drive yokes for horizontal pivoting, and each said drive arm having a drive arm clevis for pivotally receiving the free end of its respective drive link for vertical pivoting, each said drive arm being pivoted intermediate its ends to its respective side plate, whereby linear motion of the piston rod toward the drive arms causes each drive arm to pivot about its side plate pivot point and thus cause the lower end of the drive arms to drive the two boxed anchors into final operative position on the rail base flange.

28. The structure of claim 27 wherein each drive arm has a replaceable drive block insert at its lower end to contact and drive the anchor.

29. The structure of claim 26 and further including a pair of adjustable stops secured to the respective side plates opposite the upper ends of the drive arms to limit the travel of the upper ends of the drive arms.

* * * * *